US011147326B1

(12) United States Patent
Hollo

(10) Patent No.: US 11,147,326 B1
(45) Date of Patent: Oct. 19, 2021

(54) COMBINATION GLOVE AND PHONE MOUNT ASSEMBLY

(71) Applicant: Suzanne Hollo, Rockaway Park, NY (US)

(72) Inventor: Suzanne Hollo, Rockaway Park, NY (US)

( * ) Notice: Subject to any disclaimer, the term of this patent is extended or adjusted under 35 U.S.C. 154(b) by 0 days.

(21) Appl. No.: 16/841,772

(22) Filed: Apr. 7, 2020

(51) Int. Cl.
*A41D 19/00* (2006.01)
*A45F 5/02* (2006.01)
*A45F 5/00* (2006.01)

(52) U.S. Cl.
CPC ..... *A41D 19/0037* (2013.01); *A45F 5/02* (2013.01); *A45F 2005/008* (2013.01); *A45F 2005/023* (2013.01); *A45F 2005/026* (2013.01); *A45F 2200/0516* (2013.01)

(58) Field of Classification Search
CPC ..... A41D 19/0037; A45F 2005/008; A45F 2200/0516; A45F 2005/026
See application file for complete search history.

(56) References Cited

U.S. PATENT DOCUMENTS 7,334,711 B1 2/2008 Winters
8,714,421 B2 * 5/2014 Norling ..... F16M 11/14 224/197
8,740,270 B1 6/2014 Mizell
D716,287 S 10/2014 Ambriz
D739,610 S 9/2015 Richmond
9,149,077 B1 10/2015 Browning
9,667,050 B1 5/2017 Vrame
10,172,399 B1 * 1/2019 Rivers ..... A41D 19/0037
10,383,379 B2 * 8/2019 Hollo ..... A45F 5/02
10,904,372 B2 * 1/2021 Liyanaratchi ..... A45F 5/00
2006/0113338 A1 * 6/2006 Harrison, Jr. ..... G06F 1/163 224/219
2007/0083979 A1 4/2007 Daniels
2007/0099469 A1 5/2007 Sorensen
2007/0101479 A1 5/2007 Turner
2007/0262112 A1 11/2007 Butler
2008/0084390 A1 4/2008 Jones
2012/0138647 A1 * 6/2012 Norling ..... A45F 5/00 224/267
2012/0291256 A1 * 11/2012 Yu ..... F16M 11/10 29/428
2014/0073376 A1 3/2014 Noble Nava
2015/0237181 A1 8/2015 Khan
2017/0179995 A1 6/2017 Oviedo
2018/0295908 A1 * 10/2018 Hollo ..... A45F 5/02

* cited by examiner

*Primary Examiner* — Justin M Larson

(57) ABSTRACT

A combination glove and phone mount assembly for mounting a personal electronic device to a user's hand includes a glove that is wearable on a user's hand. A track is coupled to and extends partially around the glove. A receiver slidably engages the track thereby facilitating the receiver to be slid substantially around the glove. A mount is removably attachable to the receiver and the mount releasably engages a personal electronic device. In this way the mount retains the personal electronic device on the glove to facilitate hands free use of the personal electronic device.

9 Claims, 7 Drawing Sheets

COMBINATION GLOVE AND PHONE MOUNT ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to phone mount devices and more particularly pertains to a new phone mount device for mounting a personal electronic device to a user's hand.

(2) Description of Related Art Including Information Disclosed Under 37 CFR 1.97 and 1.98

The prior art relates to phone mount devices including a portable mount that can be attached to a personal electronic device for mounting on a user's hand. Additionally, the prior art discloses a general purpose connector that includes a ball that can removably engage a socket and which also includes magnets for retaining the ball in the socket. The prior art discloses a carrying case which has a cell phone holder and a sleeve for holding credit cards and identification cards. The prior art also discloses a glove that has a rotatable mount that can engage a smart phone for rotatably attaching the smart phone to the glove.

BRIEF SUMMARY OF THE INVENTION

An embodiment of the disclosure meets the needs presented above by generally comprising a glove that is wearable on a user's hand. A track is coupled to and extends partially around the glove. A receiver slidably engages the track thereby facilitating the receiver to be slid substantially around the glove. A mount is removably attachable to the receiver and the mount releasably engages a personal electronic device. In this way the mount retains the personal electronic device on the glove to facilitate hands free use of the personal electronic device.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
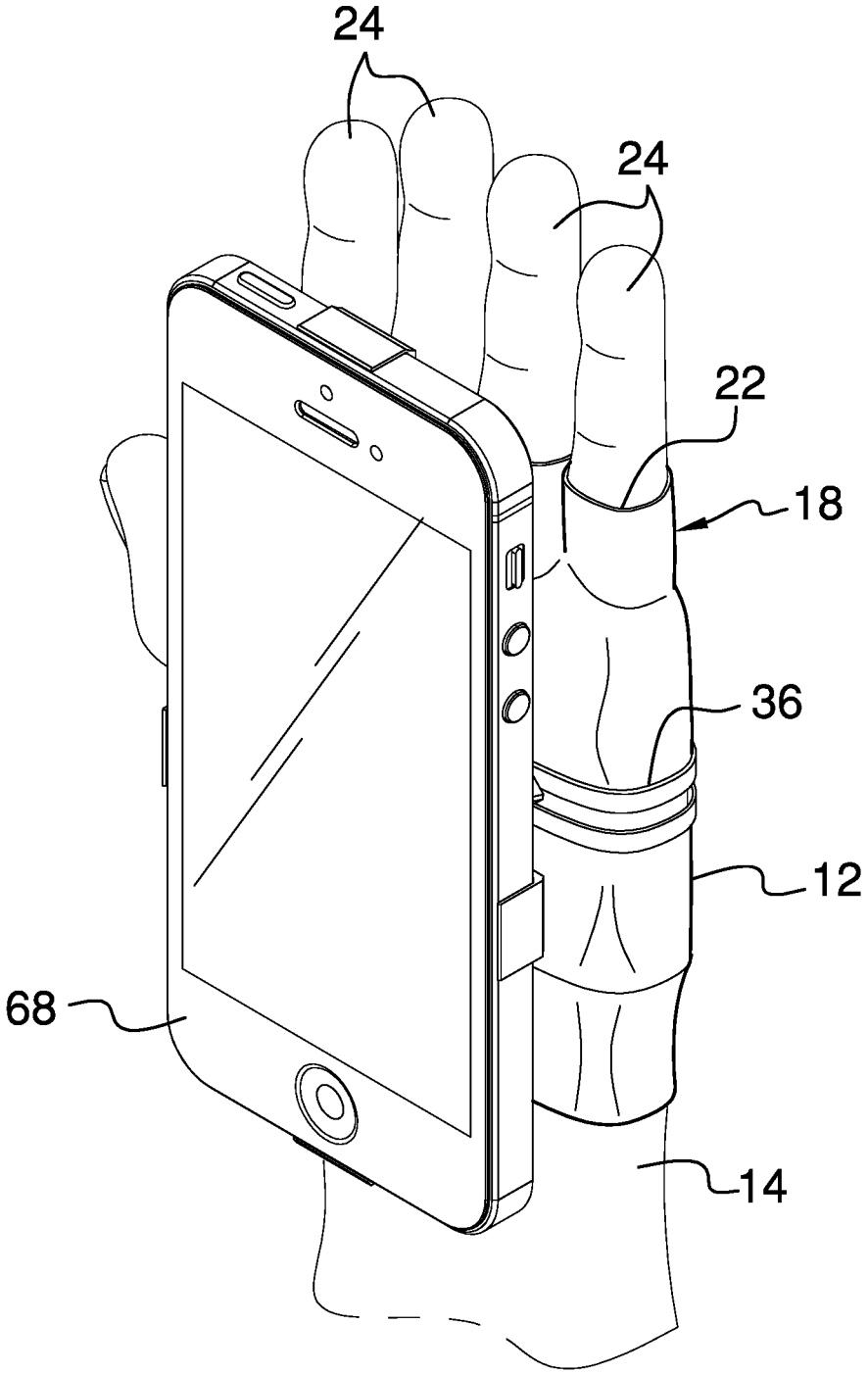
FIG. 1 is a perspective in-use view of a combination glove and phone mount assembly according to an embodiment of the disclosure.
Figure 2:
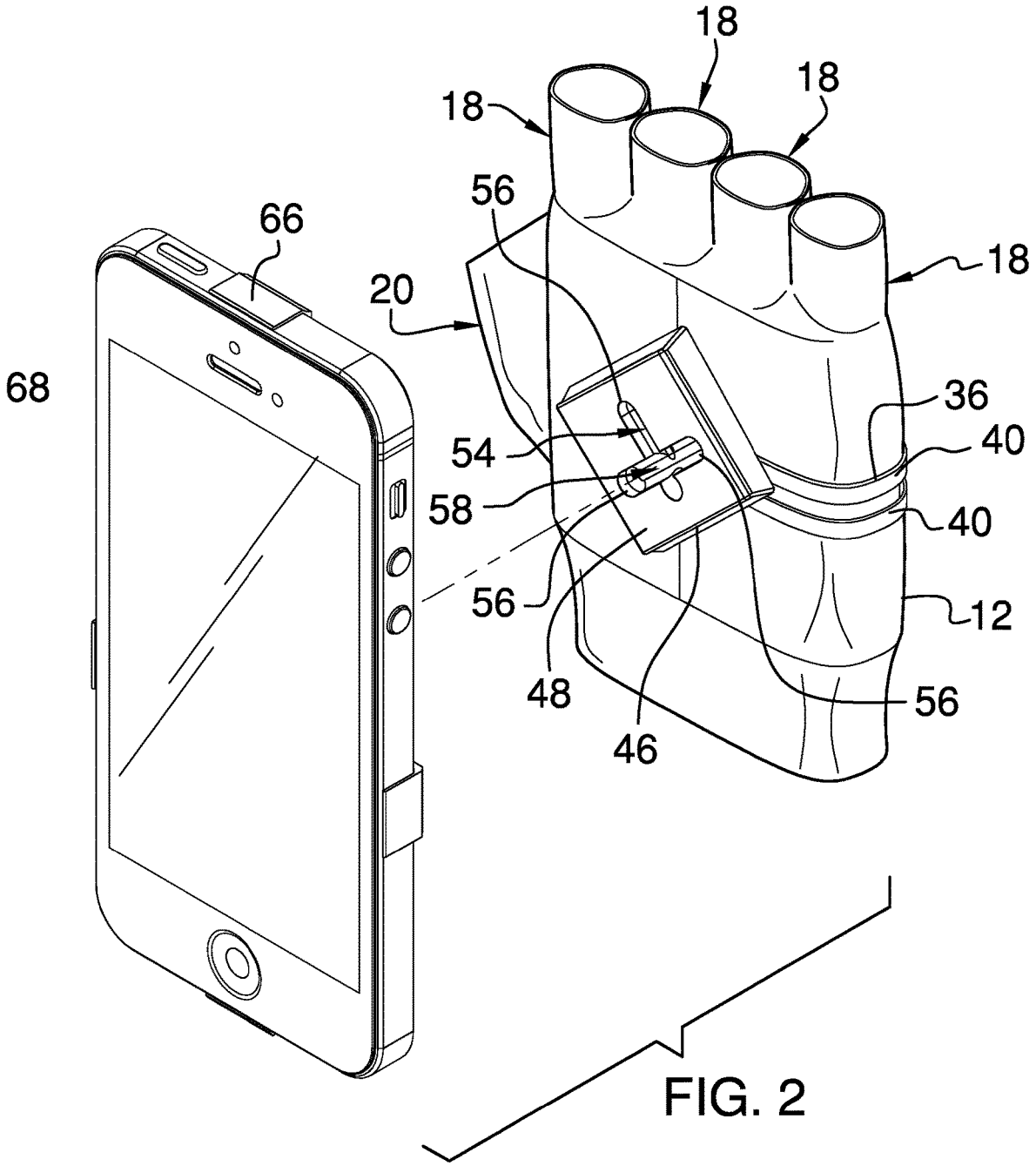
FIG. 2 is an exploded perspective view of an embodiment of the disclosure.
Figure 3:
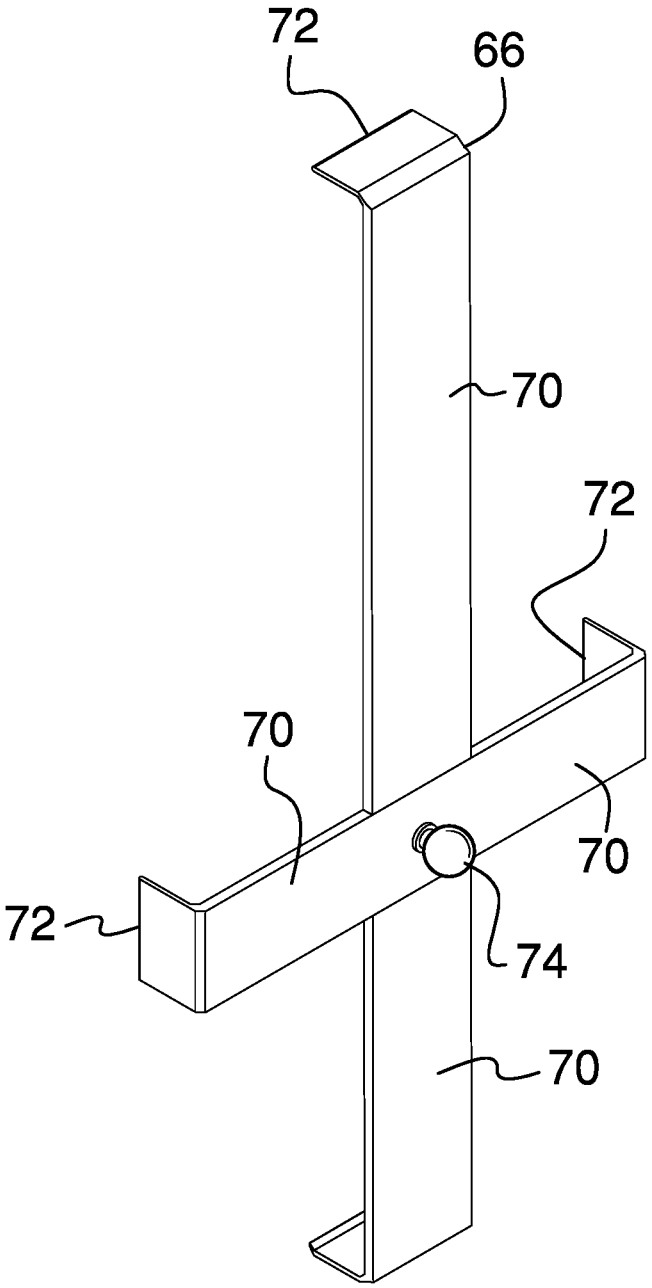
FIG. 3 is a perspective view of a mount of an embodiment of the disclosure.
Figure 4:
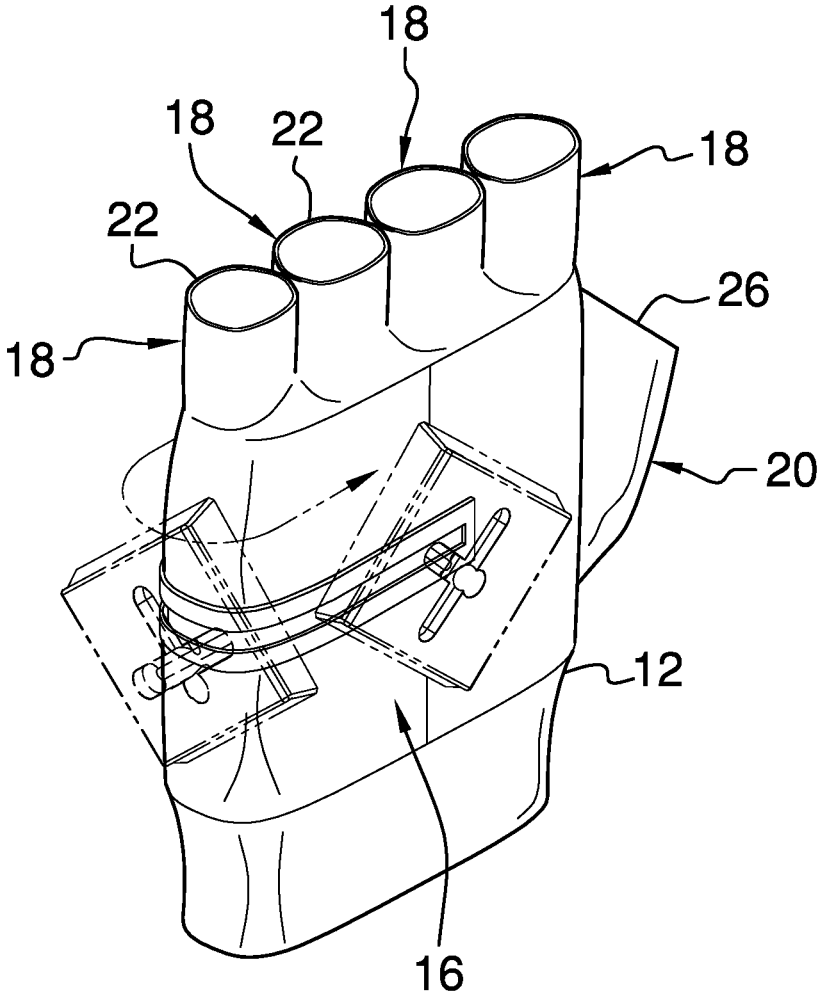
FIG. 4 is a perspective view of an embodiment of the disclosure showing a receiver being slid along a track.
Figure 5:
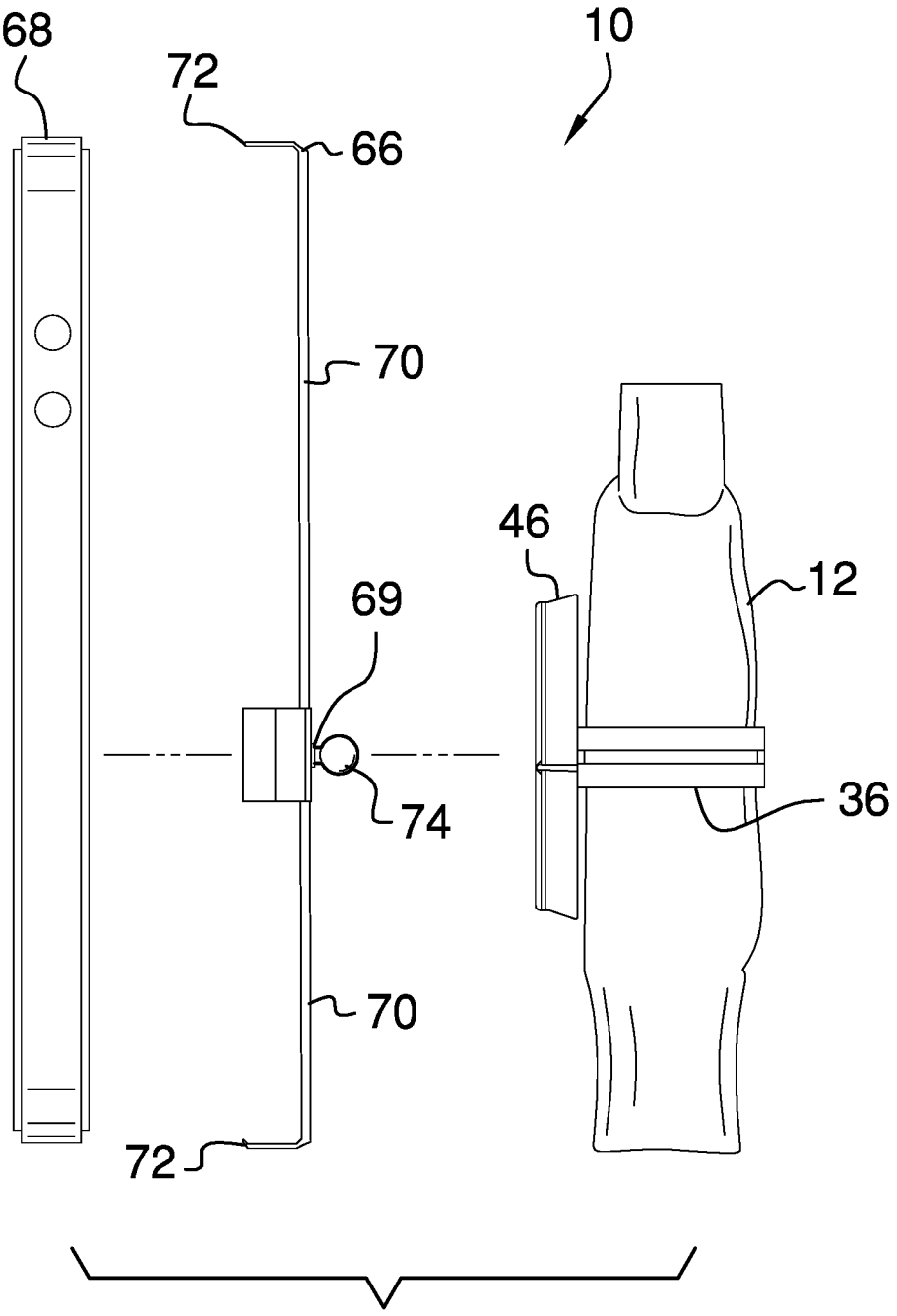
FIG. 5 is an exploded right side view of an embodiment of the disclosure.
Figure 6:
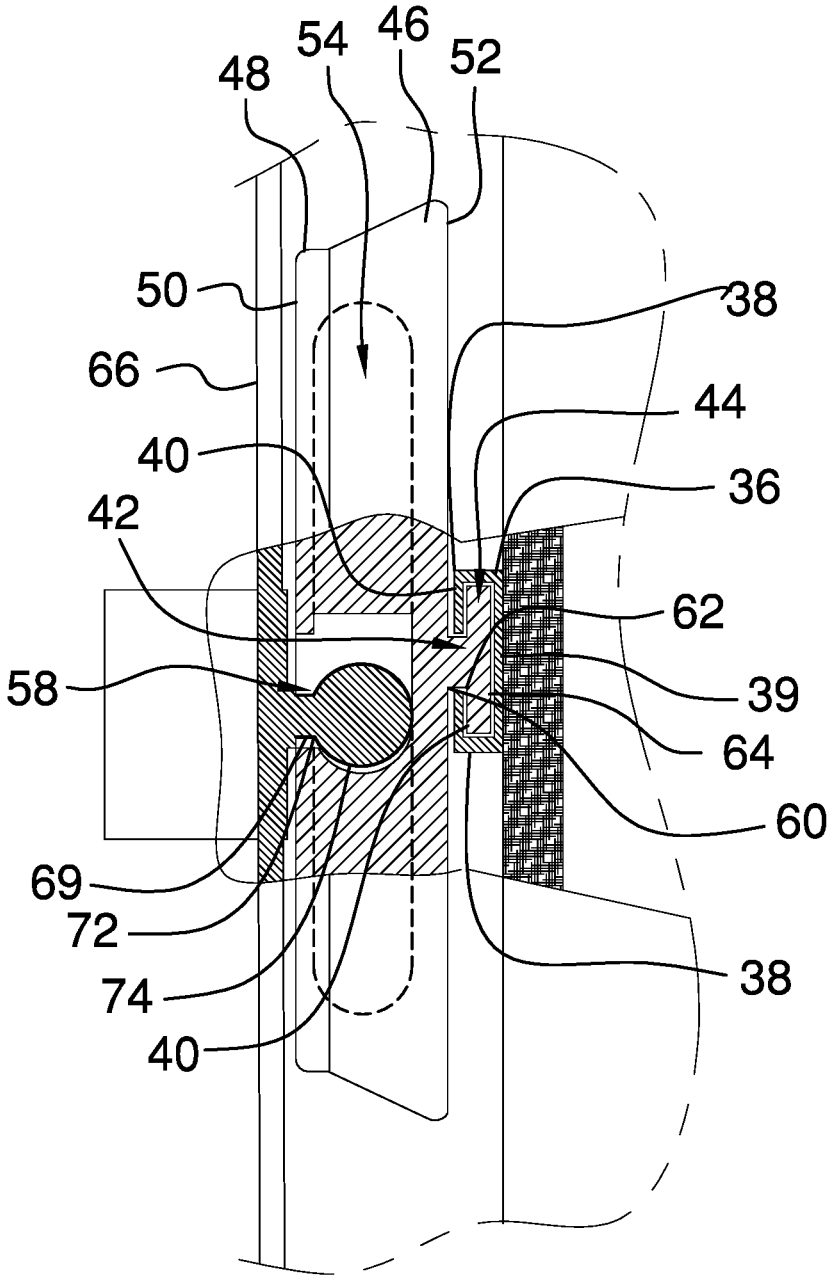
FIG. 6 is a cut-away view of a track, a receiver and a mount of an embodiment of the disclosure.
Figure 7:
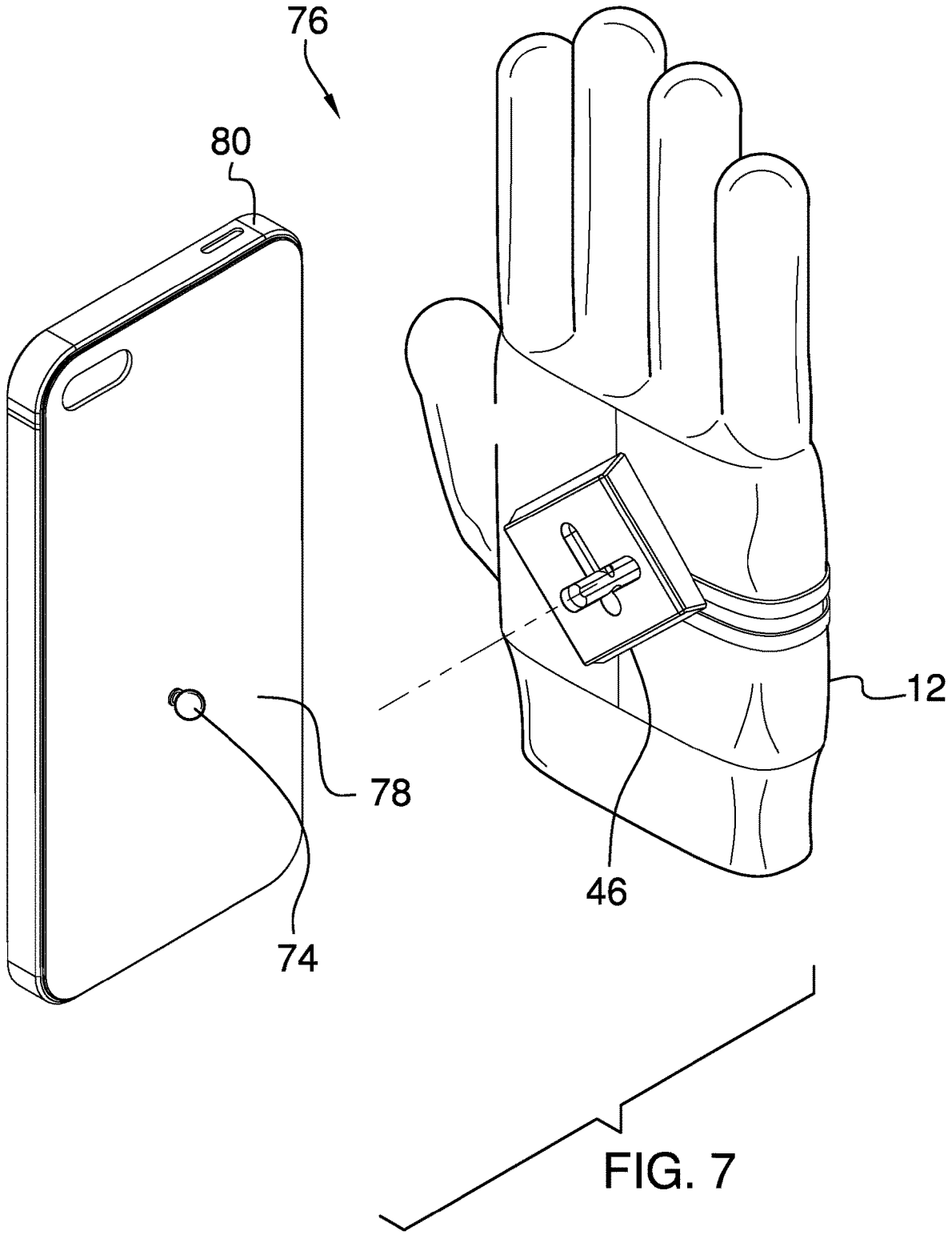
FIG. 7 is a perspective view of an alternative embodiment of the disclosure.

With reference now to the drawings, and in particular to FIGS. 1 through 7 thereof, a new phone mount device embodying the principles and concepts of an embodiment of the disclosure and generally designated by the reference numeral 10 will be described.

As best illustrated in FIGS. 1 through 7, the combination glove and phone mount assembly 10 generally comprises a glove 12 that is wearable on a user's hand 14. The glove 12 has a hand portion 16, a plurality of fingers 18 each extending upwardly from the hand portion 16 and a thumb 20 extending laterally away from the hand portion 16. Each of the fingers 18 has a distal end 22 with respect to the hand portion 16. The distal end 22 of each of the fingers 18 is open to have a respective one of the user's fingers 24 extending outwardly therefrom when the glove 12 is worn. In this way the glove 12 facilitates the user to manipulate a touch screen while the user is wearing the glove 12. Additionally, the thumb 20 has a distal end 26 with respect to the hand portion 16, the hand portion 16 has a top side 28, a bottom side 30, a first lateral side 32 and a second lateral side 34, and the thumb 20 is positioned on the first lateral side 32.

A track 36 is coupled to and extends partially around the glove 12, and the track 36 including a pair of engagements 38 extending upwardly from a base 39 of the track 36. Each of the engagements 38 includes a tab 40 that is directed toward each other to define a space 42 between the tab 40 on each engagement 38. Additionally, the tab 40 on each engagement 38 is spaced upwardly from the base 39 to define a space 44 between the tab 40 on each engagement 38 and the base 39. The track 36 extends substantially across each of the top side 28 and the bottom side 30, and the track 36 extends around the second lateral side 34 of the glove 12.

A receiver 46 slidably engages the track 36 thereby facilitating the receiver 46 to be slid substantially around the glove 12. The receiver 46 comprises a panel 48 that has a forward side 50 and a rearward side 52, and the forward side 50 has a channel 54 positioned between the forward side 50 and the rearward side 52. The channel 54 has a plurality of intersecting sections 56 such that the channel 54 has a "+" shape. Additionally, the forward side 50 has an opening 58 extending into the channel 54 and the opening 58 is aligned with an intersection between the intersecting sections 56 of the channel 54.

The receiver 46 includes a stem 60 that is coupled to and extends away from the rearward side 52 of the panel 48. The stem 60 has a distal end 62 with respect to the rearward side 52 and the stem 60 extends through the space 42 between the tab 40 of each of the engagements 38 of the track 36. The receiver 46 includes a head 64 that is coupled to the distal end 62 of the stem 60. The head 64 is positioned in the space 44 between the tab 40 of each engagement 38 and the base 39 of the track 36 such that the receiver 46 is slidably coupled to the track 36.

A mount 66 is provided that is removably attachable to the receiver 46. The mount 66 releasably engages a personal electronic device 68 to retain the personal electronic device 68 on the glove 12. In this way the glove 12 and the mount 66 facilitate hands free use of the personal electronic device 68. The personal electronic device 68 may be a smart phone or other similar device that has a touch screen. The mount 66 comprises a plurality of fingers 70 that each releasably engages the personal electronic device 68 and a stem 69 that is coupled to and extends rearwardly away from an intersection between the fingers 70 of the mount 66.

The stem 69 of the mount 66 has a distal end 72 with respect to the fingers 70 of the mount 66, and a ball 74 is coupled to the distal end 72 of the stem 69 of the mount 66. The ball 74 is extendable through the opening 58 in the forward side 50 of the panel 48 to facilitate the ball 74 to be moved through the channel 54. In this way the mount 66 facilitates the personal electronic device 68 to be positioned in a variety of orientations on the glove 12. In an alternative embodiment 76 as is most clearly shown in FIG. 7, the stem 69 and the ball 74 of the mount 66 may be integrated into a back wall 78 of a smart phone case 80. In this way the smart phone case 80 can be coupled to the receiver 46 thereby facilitating the personal electronic device 68 to be positioned for hands-free use within the smart phone case 80. Additionally, each of the fingers 18 and the thumb 20 of the glove 12 are closed.

In use, the glove 12 is worn on the user's hand 14 of choice and the receiver 46 is slid along the track 36 to a preferred location. The mount 66 is attached to the receiver 46 and the personal electronic device 68 is placed into the mount 66. In this way the personal electronic device 68 can be mounted to the glove 12 to facilitate the personal electronic device 68 to be employed without having to hold the personal electronic device 68. The mount 66 and the receiver 46 facilitate the personal electronic device 68 to be oriented either in portrait orientation or landscape orientation. Additionally, the track 36 facilitates the personal electronic device 68 to be mounted either on the palm of the user's hand 14 or the back of the user's hand 14.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A combination glove and phone mount assembly for slidably mounting a phone to a user's hand, said assembly comprising:

a glove being wearable on a user's hand;

a track being coupled to and extending partially around said glove, wherein said track includes a pair of engagements extending upwardly from a base of said track, each of said engagements including a respective tab, said tabs of said engagements being directed toward each other to define a space between each of said tabs, said tab on each of said engagements being spaced upwardly from said base to define a space between said tab on each of said engagements and said base, said track extending partially across each of a top side of a hand portion of said glove and a bottom side of said hand portion of said glove such that opposite ends of said track are aligned with an axis extending perpendicularly through said top side and side bottom side of said hand portion of said glove, said track also extending around a lateral side of said glove;

a receiver slidably engaging said track thereby facilitating said receiver to be slid substantially around said glove; and a mount being removably attachable to said receiver, said mount releasably engaging a personal electronic device wherein said mount is configured to retain the personal electronic device on said glove to facilitate hands free use of the personal electronic device.

2. The assembly according to claim 1, wherein said glove has a plurality of fingers each extending upwardly from said hand portion and a thumb extending laterally away from said hand portion, each of said fingers having a distal end with respect to said handle portion, said distal end of each of said fingers being open wherein each of said fingers on said glove is configured to have a receptive one of the user's fingers extending outwardly therefrom when said glove is worn, said thumb having a distal end with respect to said hand portion, said hand portion having a first lateral side and a second lateral side, said thumb being positioned on said first lateral side.

3. The assembly according to claim 1, wherein said receiver comprises a panel having a forward side and a rearward side, said panel having a channel being positioned between said forward surface and said rearward surface, said channel having a plurality of intersecting sections such that said channel has a "+" shape, said forward side having an opening extending into said channel, said opening being aligned with an intersection between said intersecting sections of said channel.

4. The assembly according to claim 3, wherein said receiver comprises a stem being coupled to and extending away from said rearward side of said panel, said stem having a distal end with respect to said rearward side, said stem extending through said space between each of said tabs of said engagements of said track.

5. The assembly according to claim 4, wherein:

said track includes a base, said tab on each engagement being spaced from said base; and said receiver comprises a head being coupled to said distal end of said stem, said head being positioned in said space between said tab of each of said engagements and said base of said track such that said receiver is slidably coupled to said track.

6. The assembly according to claim 1, wherein said mount comprises a plurality of fingers, each of said fingers of said mount releasably engaging the personal electronic device.

7. The assembly according to claim 6, wherein said mount includes a stem being coupled to and extending rearwardly away from an intersection between said fingers of said mount, said stem of said mount having a distal end with respect to said fingers of said mount.

8. The assembly according to claim 7, wherein:

said receiver has a channel being integrated therein; and said mount includes a ball being coupled to said distal end of said stem of said mount, said ball being extendable through said opening in said forward side of said panel to facilitate said ball to be moved through said channel wherein said mount is configured to facilitate the personal electronic device to be positioned in a variety of orientations on said glove.

9. A combination glove and phone mount assembly for slidably mounting a phone to a user's hand, said assembly comprising:

a glove being wearable on a user's hand, said glove having a hand portion, a plurality of fingers each extending upwardly from said hand portion and a thumb extending laterally away from said hand portion, each of said fingers having a distal end with respect to said handle portion, said distal end of each of said fingers being open wherein each of said fingers on said glove is configured to have a receptive one of the user's fingers extending outwardly therefrom when said glove is worn, said thumb having a distal end with respect to said hand portion, said hand portion having a top side, a bottom side, a first lateral side and a second lateral side, said thumb being positioned on said first lateral side;

a track being coupled to and extending partially around said glove, said track includes a pair of engagements extending upwardly from a base of said track, each of said engagements including a tab being directed toward each other to define a space between each of said tabs, said tab on each of said engagements being spaced upwardly from said base to define a space between said tab on each of said engagements and said base, said track extending partially across each of said top side of said hand portion of said glove and said bottom side of said hand portion of said glove such that opposite ends of said track are aligned with an axis extending perpendicularly through said top side and side bottom side of said hand portion of said glove, said track extending around said second lateral side of said glove;

a receiver slidably engaging said track thereby facilitating said receiver to be slid substantially around said glove, said receiver comprising:

a panel having a forward side and a rearward side, said forward side having a channel being positioned between said forward surface and said rearward surface, said channel having a plurality of intersecting sections such that said channel has a "+" shape, said forward side having an opening extending into said channel, said opening being aligned with an intersection between said intersecting sections of said channel;

a stem being coupled to and extending away from said rearward side of said panel, said stem having a distal end with respect to said rearward side, said stem extending through said space between said tab of each of said engagements of said track; and a head being coupled to said distal end of said stem, said head being positioned in said space between said tab of each of said engagements and said base of said track such that said receiver is slidably coupled to said track; and a mount being removably attachable to said receiver, said mount releasably engaging a personal electronic device wherein said mount is configured to retain the personal electronic device on said glove to facilitate hands free use of the personal electronic device, said mount comprising:

a plurality of fingers, each of said fingers of said mount releasably engaging the personal electronic device;

a stem being coupled to and extending rearwardly away from an intersection between said fingers of said mount, said stem of said mount having a distal end with respect to said fingers of said mount; and a ball being coupled to said distal end of said stem of said mount, said ball being extendable through said opening in said forward side of said panel to facilitate said ball to be moved through said channel wherein said mount is configured to facilitate the personal electronic device to be positioned in a variety of orientations on said glove.

* * * * *